United States Patent [19]

Weisgerber

[11] 4,402,264

[45] Sep. 6, 1983

[54] APPARATUS FOR ADJUSTING THE INK METERING DEVICE OF A PRINTING MACHINE INKING MECHANISM

[75] Inventor: Willi Weisgerber, Johannisberg, Fed. Rep. of Germany

[73] Assignee: Miller-Johannisberg Druckmaschinen GmbH, Wiesbaden, Fed. Rep. of Germany

[21] Appl. No.: 273,773

[22] Filed: Jun. 15, 1981

[30] Foreign Application Priority Data

Jul. 9, 1980 [DE] Fed. Rep. of Germany ..... 3025980

[51] Int. Cl.[3] ..... B41F 31/04; B41F 31/06

[52] U.S. Cl. ..... 101/365

[58] Field of Search ..... 101/365, 366, 363, 350, 101/207-210, 157, 169; 15/256.51; 118/261

[56] References Cited

U.S. PATENT DOCUMENTS

| | | | |
|---|---|---|---|
| 814,037 | 3/1906 | Greenway, Jr. | 101/365 |
| 977,170 | 11/1910 | Custer | 101/365 |
| 1,801,935 | 4/1931 | Pfister | 101/365 |
| 2,190,929 | 2/1940 | Behrens | 101/365 |
| 3,424,084 | 1/1969 | Chambon | 101/365 X |
| 3,922,966 | 12/1975 | Despot | 101/365 |

FOREIGN PATENT DOCUMENTS

| | | | |
|---|---|---|---|
| 1243696 | 6/1964 | Fed. Rep. of Germany | 101/365 |
| 2430643 | 1/1976 | Fed. Rep. of Germany | 101/365 |
| 266916 | 3/1927 | United Kingdom | 101/365 |

*Primary Examiner*—J. Reed Fisher

*Attorney, Agent, or Firm*—Harding, Earley, Follmer & Frailey

[57] ABSTRACT

Apparatus for adjusting the position of an ink blade at individual locations along its length, or the position of individual ink metering elements, relative to an ink ductor in a printing machine inking mechanism by rotatable set screws, having a position locking transmission between each set screw and the free end of the ink blade in the respective location or of the associated ink metering elements, for positively increasing or reducing the feed gap of the ink blade or ink metering elements which at its underside is fixedly connected to transversely extending pivot pins, in which each set screw is associated with a respective joint, having a pivot axis which extends transversely with respect to the set screw center line and parallel to the plane of the ink blade or ink metering elements, secured to one end of the associated set screw, which end, in use, projects out of an ink fountain into which the set screw is adjustably screwable and mountable, one end of a respective adjusting lever which is disposed approximately perpendicularly to the ink blade or ink metering elements being mounted pivotally and rotatably on the associated setting screw by means of the joint, while the other end of the lever is mounted pivotally on the respective pivot pin which is secured to the underside of the ink blade or ink metering elements.

6 Claims, 2 Drawing Figures

Figure 1:
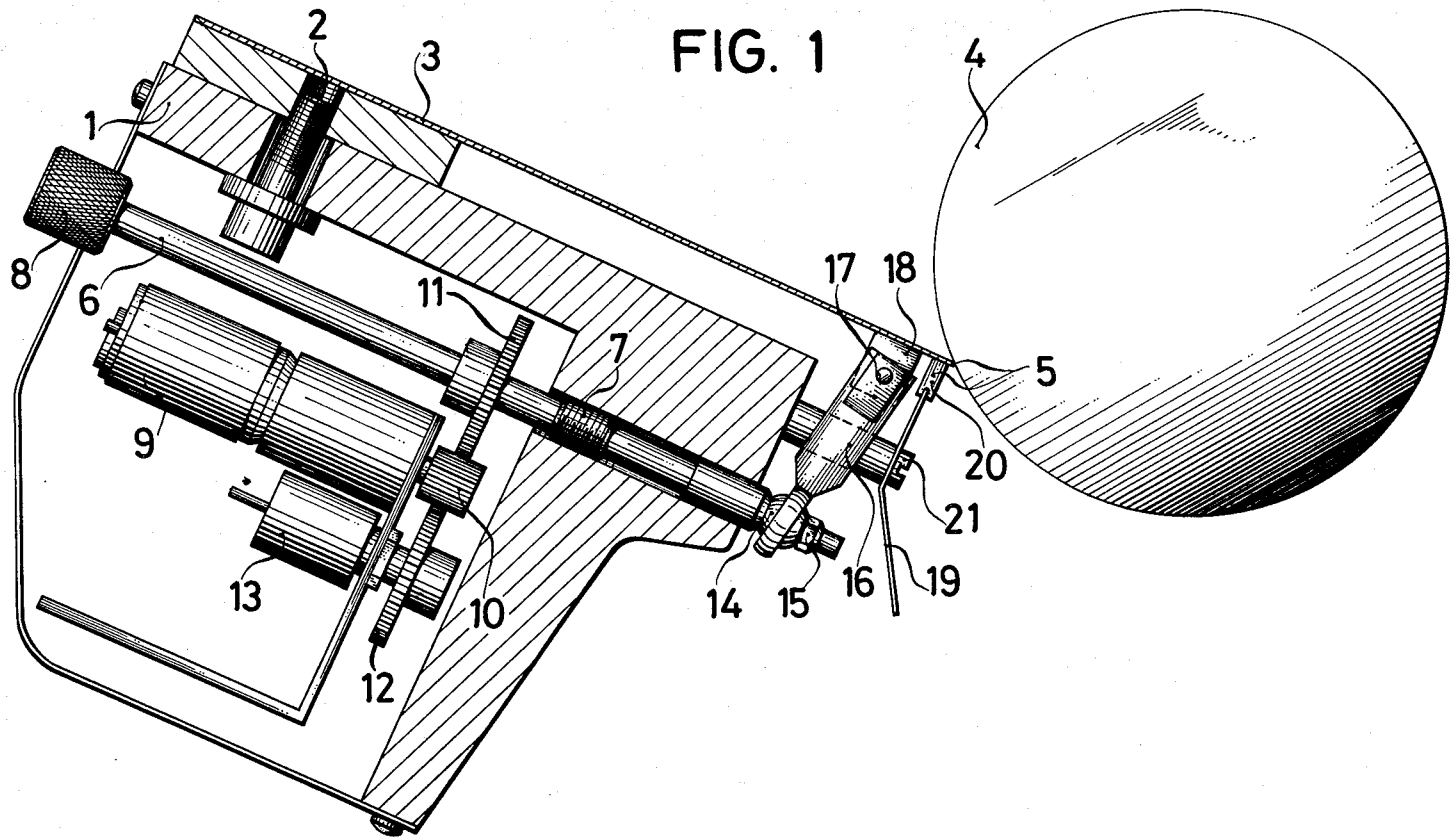

APPARATUS FOR ADJUSTING THE INK METERING DEVICE OF A PRINTING MACHINE INKING MECHANISM

This invention relates to apparatus for adjusting selectively the ink metering device of a printing machine inking mechanism relative to the ink fountain roller or ductor. More particularly, the invention relates to novel control means for adjusting the metering device at individual lengthwise spaced locations along the ink feed gap between such device and the ductor. The ink metering device may, for example, comprise a single elongated member, such as an ink blade extending over the entire width of the printing area, or it may comprise a plurality of individual ink metering elements.

The supply of ink to a printing machine is varied in different areas of the printing, depending on the individual requirements for ink of the respective images to be printed. The supply of ink, moreover, also depends on other factors, such as the temperature of the inking mechanism, the temperature of the printing plate, the consistency of the ink, moisture control, the peripheral speed of the ink fountain roller or ductor and the hydrostatic pressure of the ink on the ink metering device, such as an ink blade or individual ink metering elements. Changes in such influencing factors, which occur from time to time in continuous printing, make it necessary for the flow of ink from the ink fountain roller to the inking mechanism to be varied over the width of that mechanism. The manner in which this most generally is done involves changing the setting, i.e. the so-called feed gap or feed position, of the free end of the ink metering device at selected or individual locations relative to the ink fountain roller.

In known inking mechanisms utilizing an ink metering blade, the blade is adjusted selectively at spaced locations along its length by means of a plurality of rotatable set screws. The set screws may be rotated manually or by means of individual control motors so as to act, via a transmission means associated with each set screw, on the free end of the ink blade. In such arrangement, the ink metering blade may be formed of one piece, and may comprise a member with longitudinally spaced slots for defining individual adjustment locations. But in place of such a blade, a plurality of individual ink metering elements may be utilized. Most transmission means disposed between the set screws and the ink metering device include elements which operate simply by the application of a force, such as cams, inclined surfaces, tapered screw tips and the like. Such elements can be used only to move the ink metering blade, or other ink metering device, toward the ductor or ink fountain roller. Thus, those elements are operative only to produce a reduction in the gap between the ink metering device and the ductor, relative to the basic position of the device. In contrast, Drasnar German Pat. No. 1,243,696 discloses an inking mechanism wherein the ink metering blade can be adjusted positively in both directions from its basic position.

The desired range of adjustment of the ink metering device, e.g. the adjustments at the free end of the ink blade, or of individual ink metering elements, often is in terms of only hundredths of a millimeter. Since the pitch of the threads of the set screws cannot be made sufficiently small, relatively expensive transition means, comprising a plurality of members and involving considerable frictional resistance, are required to produce the severe step-down ratio necessary in respect of the movements as between the set screws and the ink blade or ink metering elements. A separate such transition means is required for each individual set screw.

In the apparatus of German Pat. No. 1,243,696 referred to above, having positive adjustability of the ink metering blade in both directions, each transition means comprises a single arm lever mounted pivotally relatively accurately below the free end of the blade, and has a recess into which engages a transverse pin secured to the underside of the blade. The single arm lever extends approximately parallel to, and below the ink blade, and at its free end carries a toothed segment into which the threads of the set screw engage.

This construction requires that the lower part of the ink fountain or reservoir be open toward the ductor. This detrimentally affects the rigidity of the ink fountain, which is heavily loaded by the very high forces occurring at the ink blade. In addition, essential parts of the transmission means, namely the pivot pin of the single arm lever, the slot-like recess in the lever and the transverse pin which is disposed in that recess, and which is secured to the underside of the ink blade, are disposed in the region of the ink which drops from the front edge of the ink blade. This results in fouling of those components and making it difficult to clean off ink which has dried thereon. In addition, because there is only linear contact between the pivot pin and the slot-like recess, the recess suffers from a relatively rapid rate of wear, so that there no longer is any guarantee of accurate and positive adjustment of the inking gap.

The problem solved by the present invention is to provide a control of adjustment transmission means between each set screw and the free end of the ink metering blade or device which, while ensuring the desired high step-down ratio in respect of the movements of the screws and the ink blade, is composed of a very small number of components, can be satisfactorily manipulated positionwise, and operates in a manner so that it can also be used for positive adjustment of the ink blade in both directions.

According to the invention, there is provided apparatus for adjusting the position of the ink metering device at selected locations relative to the ink ductor or fountain roller in a printing machine inking mechanism. In the case of an ink metering blade, adjustment occurs at spaced locations along its length, whereas in the case of plural ink metering elements, selected elements are adjusted individually. The adjustments are carried out by rotatable set screws having a novel position-locking transmission disposed between each set screw and the corresponding adjustment location on the free end of the ink blade, or between each set screw and its associated ink metering element. The arrangement provides for selectively and positively increasing or reducing the inking feed gap between the ink metering device and the ductor at selected locations along the gap.

The set screws are threadingly engaged within internally threaded bores formed in the solid, rigid structure of the ink fountain, and have free ends protruding outwardly of the front portion of the fountain. Each set screw mounts on its free end a joint which provides a pivotal axis extending transversely of the longitudinal axis of the set screw and parallel to the plane of the ink metering device, irrespective of whether that device is an ink blade or comprises plural ink metering elements. Each set screw is connected to its corresponding adjustment location on the ink metering device by means of an adjusting lever disposed approximately perpendicularly to the metering device. Each adjusting lever has one end connected pivotally and rotatably to its associated set screw by means of the set screw joint, while the other end of the lever is connected pivotally to a transversely extending pivot pin secured to the underside of the ink metering device, whether in the form of an ink blade or plural ink metering elements. The adjusting levers are articulatable at their opposite ends, and have only those two points of articulation.

In consequence of the arrangement and positioning of the adjusting levers with respect to the set screws on one hand, and with respect to the free end of the ink metering device on the other hand, each pivotal adjusting lever is disposed in the vicinity of the so-called dead center point and therefore produces a considerable step-down ratio in respect of movements, and a considerable step-up ratio in respect of forces, as between the set screws and the ink metering device. The conditions of loading on the individual parts of such transmission means are favorable, since the adjusting levers are subjected only to pressure or traction loadings and the set screws have only short ends projecting out of the solid portion of the ink fountain which are subjected to a bending load. Preferably, the ink fountain is of solid, very rigid construction at its forward end, which is located in the vicinity of the free end of the ink metering device. The solid front end of the ink fountain is interrupted only by the several spaced bores threadingly mounting the set screws internally thereof, and which obviously do not affect the rigidity of the ink fountain.

Since the range of pivotal movement provided by the joints on the set screws need be only very small, the joints may be ball joints, and preferably are releasably secured on the set screws in order to facilitate removal of the ink metering device. If desired, the joint may be of the type in which the sliding surfaces are replaced by a resilient layer, such as vulcanized rubber.

It is preferred to ensure that, within the range of adjustment of the feed gap between the ink metering device and the ductor, the adjusting levers not be permitted to move into an actual dead center position, even when the manufacturing tolerances of all the components are combined together in a disadvantageous manner. For this reason, in accordance with the invention, the arrangement is such that, over the entire range of adjustment of the ink feed gap, the adjusting levers extend at an angle slightly less than 90° with respect to the ink metering device, whether it be an ink blade or plural individual ink metering elements.

Figure 2:
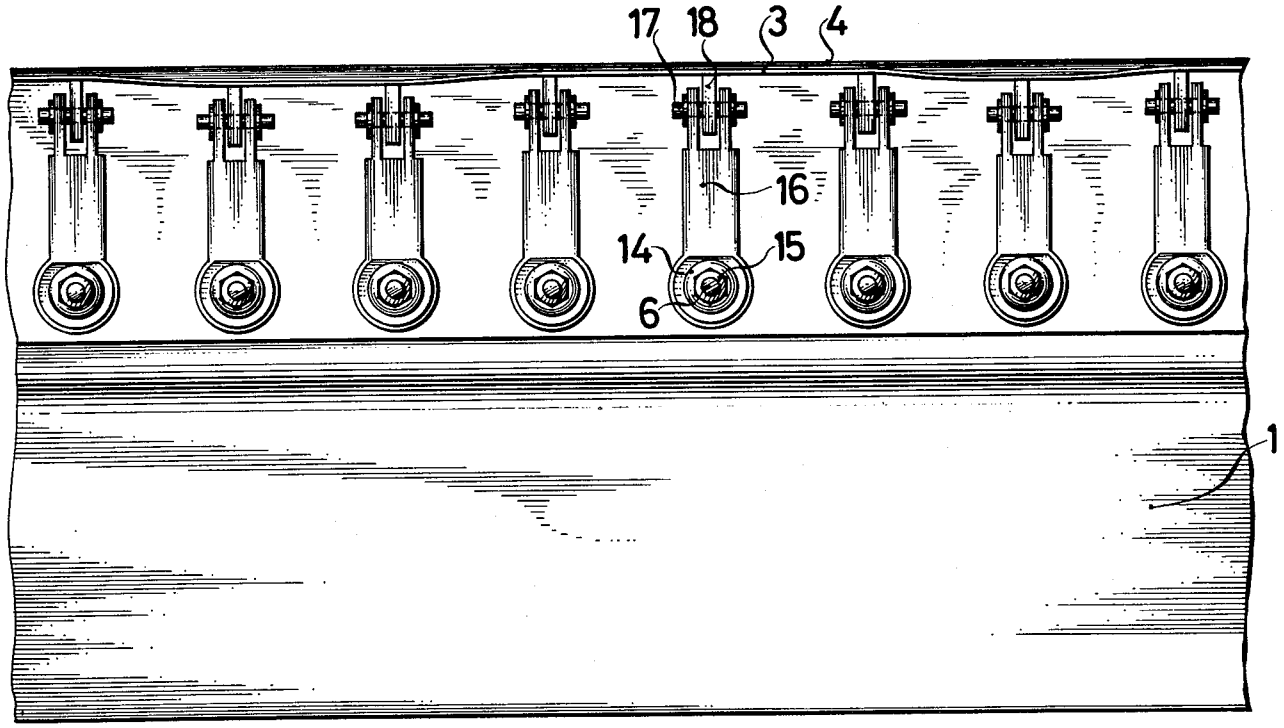

For a better understanding of the invention, and in illustration of a preferred embodiment thereof, reference now will be made to the accompanying drawing, in which FIG. 1 is a partial view in vertical section through an ink reservoir or fountain of a printing machine inking mechanism embodying this invention, the section being taken through the longitudinal axis of one of the set screws for adjusting the ink metering device, and FIG. 2 is a fragmentary, transverse view in elevation of the ink metering device of FIG. 1 showing a plurality of the individual adjusting levers of the invention with their respective pivot points.

In the drawing, the ink metering device preferably is shown as being an ink blade 3, although it is to be understood that the invention is equally applicable with other forms of ink metering devices, including particularly a plurality of individual ink metering elements. The ink blade 3 is secured to the solid, rigid construction of the front end of an ink reservoir or fountain 1 in the usual manner by a plurality of screws 2, and is adjustable as a unit toward or away from the ink fountain roller or ink ductor 4 in the usual manner.

The front edge 5 of the ink blade 3 cooperates with the ductor 4 in the usual manner to form an adjustable feed gap, the magnitude of which determines the amount of ink transferred by the ductor 4. The ink blade 3 is adjustable at individual spaced locations along its length relative to the ductor 4 by means of a plurality of spaced, parallel set screws 6. The several set screws 6 are disposed internally of a corresponding plurality of bores formed in the solid portion of the ink fountain 1. By means of a screw thread arrangement 7, each set screw 6 is separately adjustable axially relative to fountain 1. Axial or longitudinal adjustment of the set screws 6, for increasing or reducing selectively the feed gap between the edge 5 of the ink blade 3 and the ductor 4, may be effected by means of screw heads 8 formed on each set screw at one end thereof. Alternatively, adjustment of the set screws may be effected by a plurality of electric motors 9 provided with pinions 10 and gear wheels 11. In the latter arrangement the pinions 10 also drive gear wheels 12 of a conventional type of actual value detector 13 such as, for example, a potentiometer used for display and adjustment purposes.

At its end opposite from the head 8, each set screw 6 has a short end projecting out of the ink fountain 1. Mounted on the protruding or free end of each set screw is a joint 14 providing a pivot axis extending transversely to the longitudinal axis of the set screw and parallel to the plane of the ink blade 3. Preferably, the joints 14 are in the form of ball joints releasably mounted on the protruding ends of their set screws 6 by means of nuts 15.

Pivotally mounted on each ball joint 14 of each set screw 6 is an articulatable adjusting lever 16, said lever being pivotal and rotatable about the aforesaid pivot axis of the joint 14. The opposite end of each lever 16 is connected pivotally to the ink blade 3 by means of a pivot pin 17 fixably connected to the underside of the blade 3 by a lug 18 affixed to the blade in the vicinity of its front edge 5. Each adjusting lever 16 has only two points of articulation, which are located at the opposite ends of the lever. FIG. 2 illustrates the preferred disposition of the set screws 6 and the adjustment transmission mechanism comprising ball joints 14, adjusting levers 16, pivot pins 17 and lugs 18 disposed in uniformly spaced relation longitudinally of the ink fountain 1, ink blade 3 and ductor 4 to provide control means for adjusting selectively the inking feed gap between the front edge 5 of the ink blade 3 and ductor 4 at individual longitudinally spaced locations along said feed gap. The pivot pins 17 connecting the adjusting levers 16 to the ink blade 3 are disposed generally transversely of the longitudinal axes of the set screws 6. The ends of the adjusting levers 16 connected to the set screws 6 are provided with yokelike connectors for mounting the levers on the ball joints 14 of the set screws. Each lever 16 extends from its set screw 6 substantially perpendicularly to the ink blade 3, but the arrangement is such that the angle of each of the levers 16 to the blade 3 is somewhat less than 90° over the entire range of adjustment of the ink blade feed gap. Thus, over the entire range of adjustment, the adjusting levers 16 are close to the dead center position with respect to the ink blade 3, but cannot move entirely into the dead center position.

Secured to the underside of the ink blade 3 (FIG. 1), by means of a resilient connecting member 20, in the vicinity of the front edge 5 of the blade 3, is a plate 19 for carrying away excessive ink. The plate 19 is secured to the solid portion of the ink fountain 1 by means of screws 21.

It will be understood that the invention, as described above, is equally applicable to inking mechanisms of the character described when individual ink metering elements are utilized in lieu of the one piece ink metering blade 3. In such event, each separate ink metering element is connected to a corresponding one of the set screws 6 by means of the novel transmission mechanism previously described comprising a ball joint 14, an adjusting lever 16, a pivot pin 17 and a lug 18, each lug 18 being affixed to a separate one of the individual ink metering elements.

I claim:

1. In a printing machine inking mechanism having an ink metering device, an ink fountain ductor and set screws for adjusting the ink feed gap between the metering device and the ductor, control means for adjusting selectively the ink feed gap at longitudinally spaced locations along said gap comprising:

(a) a plurality of spaced set screws supported by the ink fountain with capacity for selected longitudinal adjustment, each set screw having a relatively short free end extending outwardly of the ink fountain structure, (b) a ball joint affixed to the free end of each set screw and providing a pivot axis extending transversely of the longitudinal axis of the set screw on which the joint is mounted, said pivot axis being parallel to the plane of the ink metering device, (c) a plurality of pivot pins affixed to the ink metering device, each pivot pin being located adjacent to one of the longitudinally spaced locations along the ink feed gap, and (d) a plurality of articulatable adjusting levers interposed between the free ends of the set screws and the ink metering device, each adjusting lever being disposed approximately perpendicularly to the ink metering device and having an end connected pivotally to a set screw by mounting said lever end on the ball joint of said set screw and having an opposite end mounted pivotally on one of the pivot pins affixed to the ink metering device, whereby each adjusting lever has only two articulation points, said articulation points being located at the opposite ends of the lever.

2. The invention according to claim 1, in which the ink metering device constitutes an ink blade.

3. The invention according to claim 2, wherein (a) the ink blade has a front edge disposed proximate the ductor to provide the ink feed gap and (b) the pivot pins are affixed at spaced locations on the ink blade adjacent the free edge thereof and are disposed generally transversely of the set screws to which they are connected by the adjusting levers.

4. The invention according to claim 1, in which each adjusting lever extends at an angle somewhat less than 90° relative to the ink metering device at all positions within the full range of adjustment of the feed gap.

5. The invention according to claim 1, wherein each adjusting lever is provided with a yoke-like connector for mounting said lever pivotably and rotatably on the ball joint of the set screw to which said lever is connected.

6. The invention according to claim 1, wherein each joint is releasably secured on its respective set screw.

* * * * *